United States Patent [19]

Thomas

[11] Patent Number: 4,728,313

[45] Date of Patent: Mar. 1, 1988

[54] PRE-SEWN DOLL BODY AND BLANK FOR MAKING THE SAME

[75] Inventor: Martha N. Thomas, Louisville, Ky.

[73] Assignee: Fibre-Craft Materials Corp., Niles, Ill.

[21] Appl. No.: 705,918

[22] Filed: Feb. 26, 1985

[51] Int. Cl.[4] ..... A63H 3/02; A63H 3/08

[52] U.S. Cl. ..... 446/369; 446/387

[58] Field of Search ..... 446/369, 385, 387, 388, 446/368, 376

[56] References Cited

U.S. PATENT DOCUMENTS

| | | | |
|---|---|---|---|
| 526,319 | 9/1894 | Holmes | 446/369 |
| 623,635 | 4/1899 | Sprague | 446/387 |
| 1,180,591 | 4/1916 | Lee | 446/388 |
| 1,262,417 | 4/1918 | Wheeldon | 446/369 |
| 1,327,884 | 1/1920 | Shinn et al. | 446/369 |
| 1,485,639 | 3/1924 | Smith | 446/369 |
| 2,540,701 | 2/1951 | Thorpe | 446/369 |
| 2,636,318 | 4/1953 | Lock | 446/369 |
| 4,358,907 | 11/1982 | Moreau | 446/369 |

FOREIGN PATENT DOCUMENTS

| | | | |
|---|---|---|---|
| 250898 | 6/1926 | United Kingdom | 446/369 |

OTHER PUBLICATIONS

Mahlstedt, J; *Curious Characters*, Sioux Falls, S.D. 57105, Mar. 1983.

*Primary Examiner*—Robert A. Hafer
*Assistant Examiner*—D. Neal Muir
*Attorney, Agent, or Firm*—Lockwood, Alex, FitzGibbon & Cummings

[57] ABSTRACT

A blank for the sewing of a simulated and stuffed figure features a cruciform yet one piece form. The body, back, arms, front torso, and legs are integral. The doll is formed by folding the arm parts so that the back overlies the stomach. A single seam on each side forms torso and arms. The legs are cut so as to overlie back over front, folded on a leg length axis, and each to be sewn by one seam. Attachment of the head and turning inside out, an aperture remains for stuffing.

4 Claims, 6 Drawing Figures

PRE-SEWN DOLL BODY AND BLANK FOR MAKING THE SAME

The present invention relates generally to craft materials, and more particularly, to a construction and arrangement of cloth materials pre-sewn into shapes desirably used in the production of a body for the now-popular "soft sculpture" dolls used as playthings by children.

A "soft sculpture" doll may be thought of generally as one having either a soft or rigid head, and cloth body, stuffed enough to have a firm and definite but not rigid shape, and particularly characterized by having its wrists, hands, fingers, feet and toes formed by needle and thread stitching. Normally, the body is filled or stuffed so as to leave room for some movement of the extremities relative to the torso about hinge lines characterized by reduced stuffing in these areas.

Recently, certain forms of commercially produced complete soft sculpture dolls have been accepted by the public and sold in enormous numbers. One aspect of the success of such products is thought to be their "individual" or "homemade" appearance. A major portion of the sales effort involved in marketing these products has been the implication that the doll product is somehow the product of a personalized effort, either in bringing the product into existence, or in caring for it after it has been sold, or both.

This marketing strategy has been extremely successful. Where products are made and sold in large numbers, particularly factory made products intended to have the appearance of homemade products, the latent demand for truly homemade or largely homemade products increases substantially. Thus, in the case of well known soft sculpture dolls, there has been a significant commercial demand for counterpart dolls which may be factory made only to the minimum extent necessary, or at least to a relatively minor extent. This aspect of the recent soft sculpture doll phenomenon has enabled craft and hobby workers to produce their own versions of these products, adding whatever personal touch is appropriate.

While perhaps not a major industry in the country today, supplying materials for the craft trade is a significant business. Particularly, the craft business arouses the greatest interest during gift-giving season, principally the Christmas holidays. As a consequence, while the sales of complete soft sculpture dolls has risen dramatically, particularly in the past one or two Christmas seasons, there has also arisen a counterpart demand for doll products of this type which are equally attractive but perhaps more truly hand made. This demand is currently being satisfied by the production of the more complex parts of the dolls, usually the head, and sometimes the hands, on a finished product basis, leaving hobbyists or craft workers to purchase these manufactured components and combine them with homemade bodies.

However, inasmuch as doll making involves not only the manufacture of a characteristic body, but to a major extent, the provision of basic clothing and perhaps one or more additional changes of clothing, there is a significant demand for a doll body blank which may be actually hand made into a doll body by the hobbyist, usually a gift donor, who can also provide one or more sets of clothes for these products in the process of making a gift package. This is especially the case wherein hands, fingers, feet and toes may be imparted to the body by the hobbyist in adding "personality" to the doll.

Accordingly, there is a need for the manufacture of a simple, very economical soft sculpture doll body blank which may be manufactured and pre-sewn at very low cost and which may then have its head attached, be stuffed, and thereafter have its hands, fingers, toes, etc. formed by a hobbyist who will thereafter spend a much greater amount of time in making clothes or accessories for the finished product.

The users of such products have been gratified by the homemade aspect of these products, without feeling they are factory-made, as long as the craft worker/donor of the product has, in fact, contributed to the making of the product, especially in soft sculpturing the doll by making its own characteristic extremities.

Under these circumstances, it is an object of the present invention to provide a soft sculpture doll body blank adapted to be manufactured at lowest possible cost and to be pre-sewn into appropriate form for subsequent attachment to it of a doll head and stuffing by the hobbyist, to provide a soft sculptured doll product which can then be finished by the formation of hands and feet and fitted with clothing or accessories as desired by the maker or other user.

Another object of the invention is to provide a method laying out and manufacturing a doll body which makes maximum use of material, minimizing waste, and which may be sewn with the greatest simplicity to provide a product which is easy to stuff and to which the head may be attached with the greatest facility.

A still further object of the invention is to provide a soft sculpture doll body which will provide high quality and the desired appearance characteristics in the finished product, but which can be made so economically as to be attractive to hobby craft and other users from the price standpoint, while still providing a return on investment to the manufacturer.

Another object of the invention is to provide a soft sculpture doll body blank wherein manufacture may be accomplished by the minimum number of cuts, and wherein the finished product is able to be manufactured in a relatively foolproof manner by sewing only selected margins as indicated after a few simple folds are made.

The foregoing objects and advantages, and other inherent objects and advantages of the invention, are achieved in practice by providing a soft sculptured doll body blank, and a body made therefrom and adapted to be stuffed, wherein the body blank has a principal panel of generally cruciform shape with a lower portion of enlarged width, which is in turn subdivided into a pair of opposed leg forming panels each joined to the principal panel along a fold line area with each leg portion including opposed outer corners and inner corners defined in part by a t-slit separating the leg panels from each other, with the principal body panel and the leg panels all including margins to be overlapped and sewn before being turned inside out to form body seams.

The manner in which the foregoing and other objects and advantages of the invention are achieved in practice will become more apparent when reference is made to the following detailed description of the preferred embodiments of the invention set forth by way of example and shown in the accompanying drawings, wherein like reference numerals indicate corresponding parts throughout.

DESCRIPTION OF THE PREFERRED EMBODIMENTS OF THE INVENTION

Figure 1:
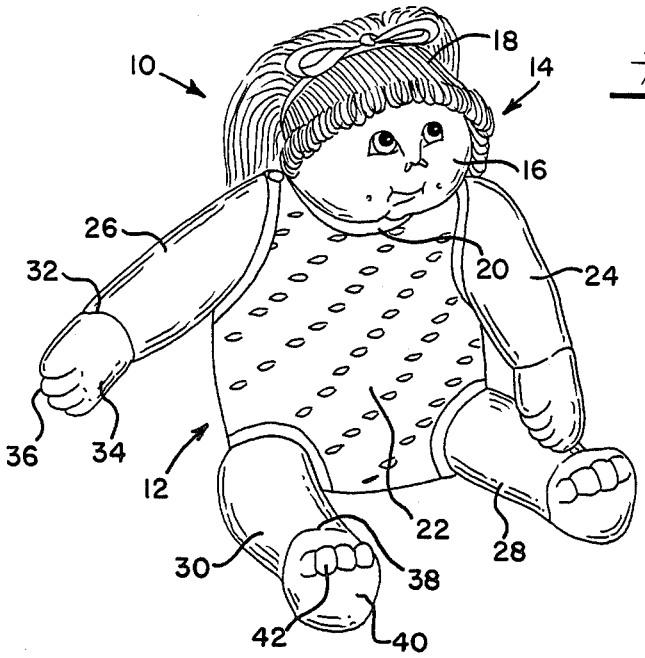
FIG. 1 is a perspective view of a finished doll product made using the pre-sewn soft sculpture body of the invention.

While it is understood that the invention may be embodied in different forms, a description of a preferred form of the invention will be made wherein the doll body blank is made from a single blank of woven material having three principal parts, each having a central fold line, wherein the legs are joined to the body by a fold line area providing ease of leg forming, and wherein the stuffing may be inserted into the body centrally thereof so as to provide access to both the legs and principal body of the doll product before body making is completed.

Referring now to the drawings in greater detail, a finished soft sculpture doll generally designated 10 may be made using the pre-sewn body generally designated 12 and made according to the invention. As is known, the finished doll 10 may include not only the body 12 but a pre-formed head portion generally designated 14 which is sold with pre-finished facial features generally designated 16 and hair 18, for example.

Figure 2:
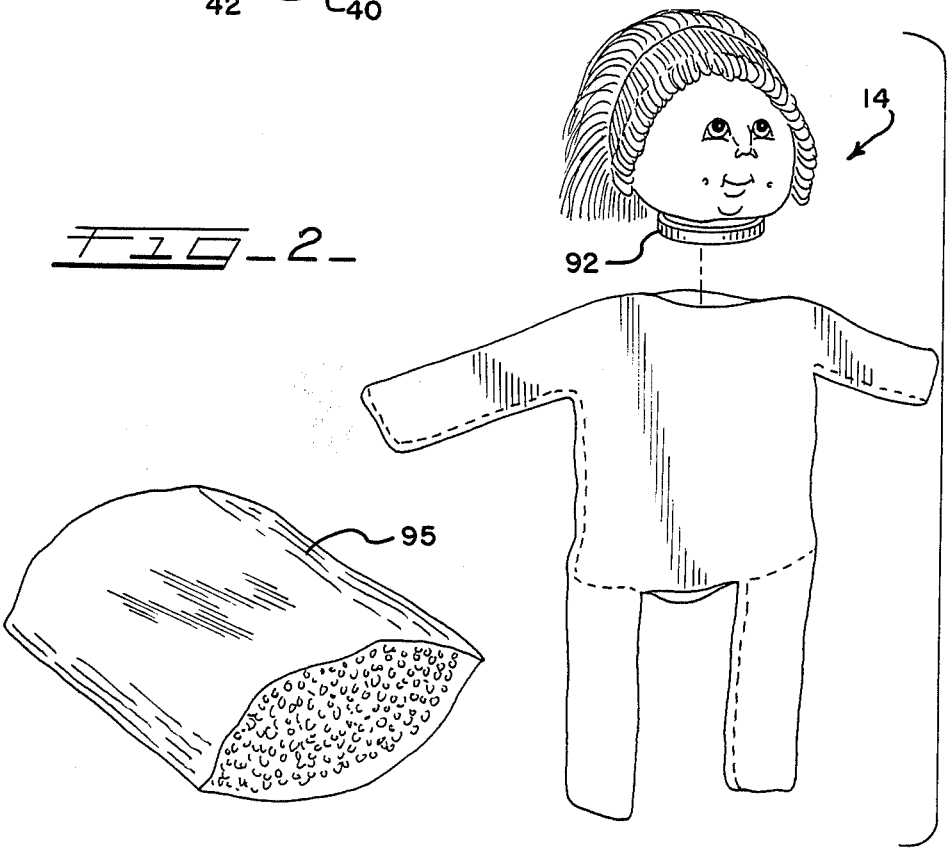
FIG. 2 is an exploded view showing the doll body, the relation of the head thereto, the appearance of the pre-sewn body before stuffing, and a pad of fiberfill stuffing before insertion into the body.

This head is usually attached about a neck area 20 by yarn, twine, or cable ties (Fig.2) in a manner to be described later. The finished doll product includes a principal body or torso section 22, left and right arm portions 24, 26 and left and right leg portions 28, 30. Characteristically, as a soft sculpture doll it also includes wrists 32, hands 34 and fingers 36, as well as ankles 38, feet 40 and toes 42, all formed by stitching done by the hobbyist after the doll body is stuffed. As shown in FIG. 2, the stuffing is a known fiber fill material furnished in the form of a mat or pad 95.

Figures 3, 4, 5, 6:
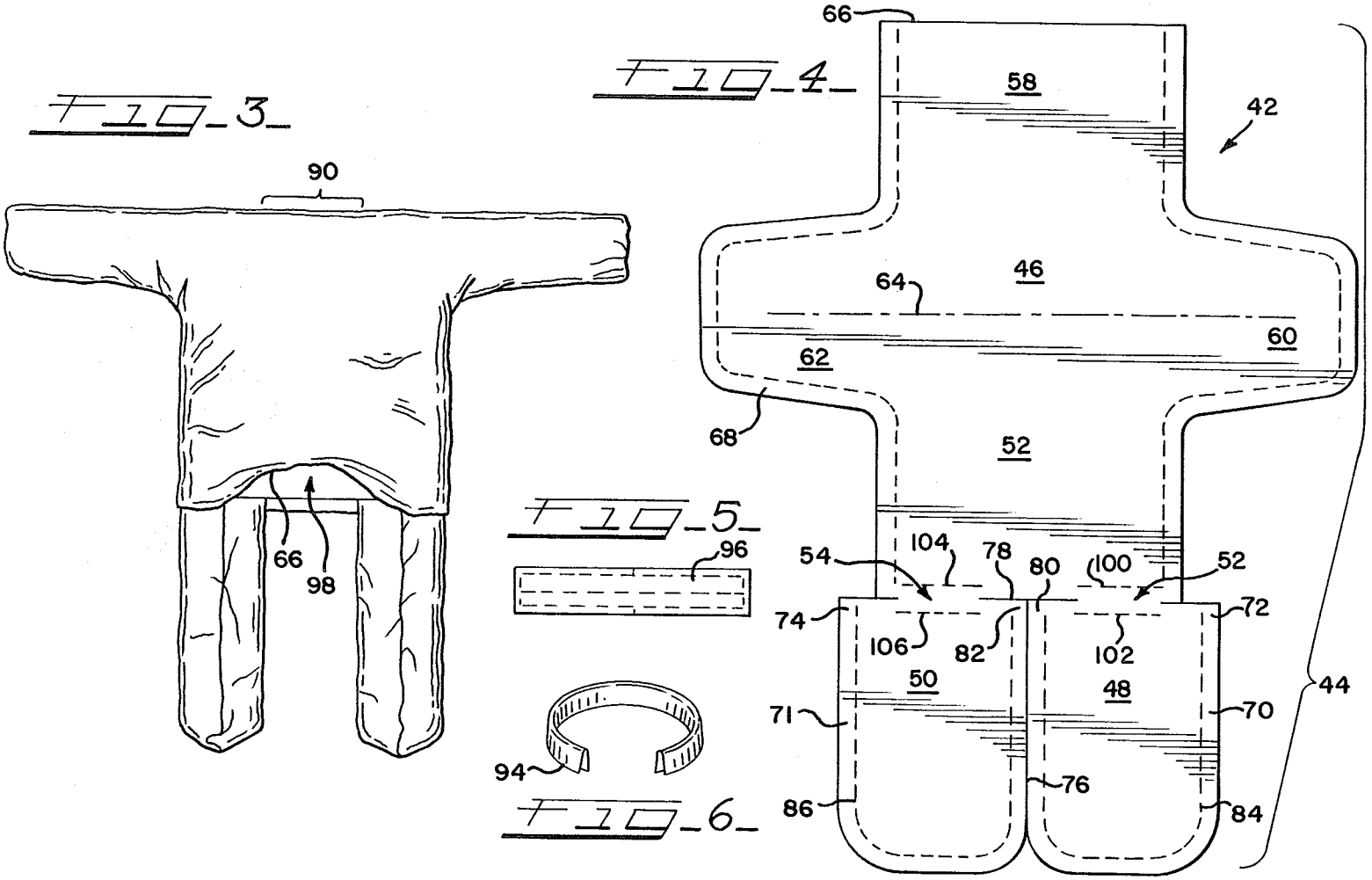
FIG. 3 is a front elevational view of a doll body made according to the invention, after sewing and turning inside out, but before head attachment and stuffing.
FIG. 4 is a layout or plan view showing the pattern of the material pre-shaped and cut in the form a doll body blank before the blank is sewn into the shape shown in FIG. 3 and stuffed for eventual use.
FIG. 5 is a plan view of a collar reinforced blank.
FIG. 6 is a perspective view of the collar reinforcement of FIG. 5 after completion but before assembly with the body.

Referring now to the manufacture of the doll body itself, this is begun by laying out and cutting a sheet of cloth material into the shape shown in FIG. 4. Referring now to FIG. 4, a body blank generally designated 42 is shown to be made from a single sheet 44 of a cloth material, formed according to the pattern of the invention. The material used is preferably a woven, relatively flexible, skin-colored polyester material. This material is laid out so as to be subdivided into a principal body forming panel 46 of generally cruciform shape and a pair of identical leg-forming panels 48, 50, joined to the body forming panel 46 along hinge line areas 52, 54.

The body forming panel 46 is subdivided into a front or chest forming panel 56, a back froming panel portion 58, and transversely extending left and right arm forming panels 60, 62. As used herein, "left" and "right" refers to the orientation of the doll's own arms and legs, rather than to right and left as shown in the drawings.

A central fold line 64 extends transversely entirely across the main body-forming panel 46. A free edge 66 of material serves in use as the bottom edge of the back panel, such edge 66 lying at the top of the blank 42 in FIG. 4, wherein the blank is shown as not yet having been folded. After the blank 42 is folded about the fold line 64, the edge 66 lies adjacent the leg panels and defines in part the opening through which the head is inserted, and through which the body is stuffed, as will appear.

A seam-forming margin 68 extends all around the body 46, except near the edge 66. Seam forming margins 70,71 are also provided for the leg panels 48, 50.

Referring now to the lower end of the body, left and right leg-forming panels 48, 50 are each shown to include laterally outer leg panel corners 72, 74 respectively. The leg-forming panels 48, 50 are preferably of the rounded end shape shown and are separated from each other by a longitudinal slit 76, which terminates in a transverse cut 78, thereby forming inner leg panel corners 80, 82.

When the leg panel margins 70, 71 are placed in overlying relation, with the pairs of corners 72, 80 and 74, 82 respectively in aligned overlying relation, and sewn on the pattern marks, leg seams 84, 86 are formed which define a pair of tubular left and right legs 28, 30, open only at the hip joint seam areas 52, 54. This permits leg stuffing before the hip joints are formed.

As is also apparent, when the body forming panel 46 of FIG. 4 is folded upon itself about the fold line 64, with the counterpart edges of arms 60, 62 being aligned and with the panels 56, 58 overlying each other, sewing along the pattern marks 88 will create body seam similar to the leg seams just described. At this point, referring to FIG. 3, the entire body, which was sewn "inside-out", is reversed or turned "right-side out", leaving the seams forming the body directed inwardly for a neat appearance. Next, a slit 90 of appropriate length, preferably two inches, is cut for the neck 92 of the head 14. In the preferred form, a reinforcing collar 94 (FIG. 6) is formed by seaming a collar forming blank 96 (FIG. 5) around its margins and folding it to double thickness. This collar is sewn in the slit 90.

At this point, the blank is again turned inside out, and the head is inverted and placed into the opening 98 formed by the edge 66 of the body blank 42 and the inner leg corners 80, 82.

Thereupon, the doll head 14 is inserted, neck up, in the opening 98, and the neck 92 is sewn or cable-tied to the collar 94 in a known manner. Finally, the body is again turned right side out, and the arms, legs and body are stuffed. Thereafter, referring again to FIG. 4, the hip joints or seams are formed by sewing in the pattern areas 100, 102, and 104, 106. Finally, the loose edge 66 may be sewn to finish the body, and the wrists, hands, fingers, feet and toes are formed by sewing, using the soft-sculpture technique.

By reference to FIGS. 3 and 4, it will be seen that the body blank is the essense of simplicity, consisting primarily of the cruciform shaped body and a pair of enlarged width, leg forming panels joined to the body and separated from each other by a longitudinal slit terminating in oppositely disposed, corner-forming cross slits. In this way, a simple fold and sew operation will create a unitary three-element body consisting of a principal body and arms portion and a pair of leg portions each having a stuffing opening therein. The collar element 94 is sometimes advantageously provided, but may be thought of as an accessory unit to strengthen the body blank in this area and to provide a more finished appearance to the doll. However, the collar element is not strictly necessary in keeping with the invention.

It has been discovered that the manufacture and sale of a body kit of this sort provides advantages in use, namely, minimizing the need for pattern layout, cutting of the texturized woven material and enabling the user to concentrate on the sculpturing or feature-forming characteristics of the doll as well as the manufacturing of clothing and accessories for it.

It will thus be seen that the present invention provides an improved doll body and body forming blank having a number of advantages and characteristics, including those referred to herein and others which are inherent in the invention.

I claim:

1. A body blank adapted to provide a doll body when sew, stuffed and formed, said body blank being made from a single piece of woven cloth material and including three principal panel portions, one being a generally cruciform shaped body-forming panel subdivided into back and chest-forming panel partions, said body forming panel being adapted to be folded along a line transverse to the axis of the blank to form the torso and arms of said body, said body-forming panel being symmetrical about said transverse fold line so that the chest and back-forming panel portions of said body-forming panel are adapted to have their counterpart outer margins in overlying registered relation when folded about said fold line and seamed so as to form a body with outwardly extending arms, and a pair of substantially identical, leg forming panels each connected at its inner end to the bottom edge of said chest-forming panel, said leg forming portions having laterally outer corners of increased lateral width with respect to said chest forming panel, said leg forming panels being separated from each other by a longitudinally extending slit terminating in left and right, laterally extending slits forming inner leg panel corners which are generally laterally aligned with said outer corners, with said leg forming panels each also being adapted to be folded along a longitudinal leg panel center line into a position such that said inner and outer leg panel corners of each leg overlie each other in aligned relation and thereafter seamed so as to form leg portions, said blank also providing an opening adjacent the lower edge of said back forming panel adapted to receive a fiber stuffing material when said blank is assembled.

2. A body blank adapted to provide, when folded, sewn and stuffed, a doll body having arms, legs and a body portion, being made from a woven cloth material and adapted to have extremities formed therein by soft sculpture sewing, said body blank comprising, in combination, three principal elements, mutually attached and each adapted to be folded about its own center line, one of said principal element being a body and armforming panel of generally cruciform shape having a longitudinal back bone axis front and rear body surface portions joined to each other along a transverse fold line in a shoulder forming area, said body and back-forming panel further including arm-forming panels with counterpart portions lying on either side of said transverse fold line, said front and rear body-forming and arm-forming panels being substantially symmetrical about said transverse line, and a pair of leg-forming panels each extending generally parallel to each other and longitudinally of said body blank, said symmetrical leg forming panel portions lying to either side of said longitudinal line and each including oppositely disposed corners adapted to be folded upon each other for seaming, one of said corners extending laterally outwardly of said front body-forming panel and the other being formed at the body blank longitudinal center line, with each of said leg-forming panels being joined at its inner edge to an adjacent edge of said body front-forming panel along a hip joint fold line area, said body blank being adapted to have said front and rear body forming panels and said leg-forming panels folded about their respective center lines, and the outer margins of said folded panels seamed adjacent their edges and turned inside out, to form a single doll body adapted to be stuffed with a fiber fill material so as to be further adapted for soft sculpture finishing.

3. A method of forming a doll body, said method comprising of cutting a sheet of a woven cloth material into a single blank form having three principal panel elements, said panel elements including leg-forming panels and a principal, body and arm-forming panel having a longitudinal center line extending along the backbone of the doll form, and being subdivided by an imaginary transverse fold line into substantially symmetrical t-shaped panel portions lying to either side of said fold line, one of said t-shaped panels having a transversely extending free edge portion and the other of said panel portions having an edge defined in part by spaced apart transverse leg-forming slits and having said leg-forming panels attached thereto, each of said t-shaped panels including arm-forming elements extending generally transversely of said longitudinal line, tapering outwardly and slightly towards said fold line, and terminating at its outer end edges by joining counterpart edges on the other of said t-shaped panel portions, said two leg-forming panels having their respective outer corners spaced laterally outwardly from the adjacent portions of said other panel portion and the inner leg-forming corners formed by one of said transverse slits, said leg panels being separated from each other by a longitudinal slit aligned with said body forming blank longitudinal center line, said legs being symmetrical about respective longitudinal center lines offset from said principal body center line, folding said leg portions about said leg center lines with said notches and remainder of said panel edges aligned and forming a seam adjacent the free edges of said leg panels, folding said body blank about its said imaginary fold line so that counterpart edges are aligned, and forming a seam on said all of those exterior edges thus formed except said free edge of said back forming panel, so as to create a folded and sewn doll body blank having body and leg cavities, turning said doll body blank inside out and stuffing said cavities with a fiber fill material, and then closing the openings through which said stuffing was inserted in said body.

4. A method as defined in claim 3 which further includes cutting a neck opening along said transverse fold line subdividing said principal body forming portion, and which still further includes the step of inserting a doll head having a reduced diameter neck portion into said body forming cavity of said blank prior to turning the same right side out, positioning said neck so it extends through said neck forming opening, securing said neck to said body in the vicinity of said opening and turning said body blank right side out so as to position said head outside said body and prior to stuffing said doll body.

* * * * *